US006895736B2

(12) United States Patent
Badiali et al.

(10) Patent No.: US 6,895,736 B2
(45) Date of Patent: May 24, 2005

(54) THREAD-GUIDING DEVICE FOR COLLECTING SPUN YARNS ON BOBBINS PARTICULARLY FOR OPEN-END SPINNING FRAMES

(75) Inventors: Roberto Badiali, Pordenone (IT); Vittorio Colussi, Cappella Maggiore (IT); Franco Siega Vignut, Maniago (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 139 days.

(21) Appl. No.: 10/378,271

(22) Filed: Mar. 3, 2003

(65) Prior Publication Data

US 2003/0218091 A1 Nov. 27, 2003

(30) Foreign Application Priority Data

Mar. 8, 2002 (IT) ..... MI2002A0499

(51) Int. Cl.[7] ..... D01H 13/26
(52) U.S. Cl. ..... 57/264; 57/400
(58) Field of Search ..... 57/264; 242/476.7, 242/477.9, 478.2, 480.9

(56) References Cited

U.S. PATENT DOCUMENTS

| | | | | | |
|---|---|---|---|---|---|
| 3,940,078 | A | | 2/1976 | Bense et al. | |
| 5,348,238 | A | * | 9/1994 | Yamauchi et al. | 242/476.7 |
| 5,848,865 | A | * | 12/1998 | Beals | 410/99 |
| 5,918,829 | A | * | 7/1999 | Fah | 242/481.4 |
| 6,003,806 | A | | 12/1999 | Simon | |
| 6,659,386 | B1 | * | 12/2003 | Rienas | 242/478.2 |

FOREIGN PATENT DOCUMENTS

| | | | |
|---|---|---|---|
| DE | 37 25 812 | | 2/1989 |
| DE | 89 15 275 | | 2/1990 |
| DE | 89152751 U | * | 3/1990 |
| DE | 199 21 630 | | 11/2000 |
| EP | 0 302 461 | | 2/1989 |
| EP | 1 342 688 | | 9/2003 |

OTHER PUBLICATIONS

EPO Search Report.

* cited by examiner

*Primary Examiner*—John J. Calvert
*Assistant Examiner*—Shaun R Hurley
(74) *Attorney, Agent, or Firm*—Hedman & Costigan, P.C.

(57) ABSTRACT

Thread-guiding device for collecting spun yarns on bobbins, particularly for open-end spinning frames, constituted by a common thread-guiding rod which carries the thread-guides for the spinning units, driven in alternate movement in front of the bobbins being formed by the motion of a driving means controlled in turn by a motor capable of alternate rotation and controlled by the control unit of the spinning frame in its alternate clockwise/counterclockwise movement as regards instantaneous speed, amplitude of angular excursion, angular coordinates of the ends of its travel.

4 Claims, 5 Drawing Sheets

22
21
40
41
42
43
44
46
47
G 22
21
51
52
53
54
55
G

THREAD-GUIDING DEVICE FOR COLLECTING SPUN YARNS ON BOBBINS PARTICULARLY FOR OPEN-END SPINNING FRAMES

FIELD OF INVENTION

The present invention relates to collecting spun yarn produced or worked by textile machines to be wound on bobbins.

BACKGROUND OF INVENTION

In the industrial production of spun yarns it is common practice for them to be collected on an idle tube carried by a bobbin-carrying arm, which rests on a rotating driving roller and takes up the spun yarn coming from a feed element to wind it onto itself. The bobbin is thus formed by pulling and winding the spun yarn on its surface, it being drawn in rotation by the roller underneath on which the bobbin being formed rests. This practice allows the spun yarn to be wound at a substantially constant linear speed, irrespective of the increasing dimensions of the bobbin and depending only on the rotation speed of said driving roller. The spun yarn is wound in spirals onto the rotating bobbin as the pick-up unit is provided with a thread-guiding device which distributes the spun yarn on the outer surface of the bobbin with backward and forward axial motion. In industry, the bobbins may be shaped like a truncated cone or a straight cylinder with substantially flat bases, with the exception of a few specific cases in which the terminal parts of the bobbins are shaped with a pronounced flare.

In the prevalent industrial use of spun yarn in bobbins, downstream working requires the bobbin to be conical in shape, for example when the spun yarn is unwound in an axial direction from the bobbin fixed on creels. This conicity is however slight and restricted to a few degrees of inclination of the generatrix of the cone in relation to its axis, generally between 2° and 6°, except for some specific uses for which "superconic" bobbins are required.

In the case of winding on a winder the most widespread device for distribution of the spun yarn on the surface of the bobbin with axial backward and forward motion consists of a spiral backward and forward groove cut into the surface of the driving roller which causes the spun yarn to perform an axial excursion of a pre-established length, for a pre-established number of turns of the roller and with a pre-established wind ratio. In other words, the yarn winding and spun yarn distribution elements operate according to a fixed speed ratio.

However, in other cases the device for distribution of the yarn on the bobbin is produced with an independent thread-guiding device, moved by its own driving element, with which the frequency of the backward and forward movement, its travel, the length of the spiral wound and the wind ratio, etc. may be modulated time by time and according to need.

Typically, distribution of the spun yarn on the bobbin with modulatable thread-guide is required in open-end spinning frames, for which distribution of the spun yarn on the bobbin with grooved cylinder does not meet the conditions required for efficacious winding on a bobbin of the desired quality. These winding conditions in particular include its wind ratio, the speed and excursion travel, which cannot be maintained at a single pre-established value, as is the case with the grooved cylinder, but must be adapted time by time to the spun yarn being produced and also modulated during production of the bobbin. There are also other impediments to the use of the grooved cylinder, both due to the geometry of the system and to the overall open-end spinning procedure.

In open-end spinning there is a further limiting condition in that the spun yarn is produced at constant linear speed and therefore must be picked up at a speed corresponding to the speed at which it is made available, substantially equal and constant, maintaining it at a moderate tension, while when forming both straight cylindrical and conical bobbins the pick-up speed typically has a pulsating trend.

It must also be borne in mind that, to compensate these pulsations of adjusting tension and path length, the elasticity of the spun yarn could be taken into account only within the limits of a few percent, also because the yarn is already stressed considerably at the operating speed of current open-end spinning frames.

To explain more clearly the problems dealt with and the technical solutions proposed with the present invention reference is made, in the description below, to pick-up of "open-end" spun yarns on bobbins, provided purely as a non-limiting example, it being explicitly specified that it may be used advantageously to wind spun yarns produced with different spinning technologies on bobbins.

BRIEF DESCRIPTION OF THE DRAWINGS

FIG. 1A shows a front view of it while FIG. 1B shows a side view of it.

FIG. 2A shows its front view while FIG. 2B shows its sectional side view.

FIG. 3A shows the front view, while FIG. 3B shows the sectional side view.

DETAILED DESCRIPTION OF THE INVENTION

Figure 1A:
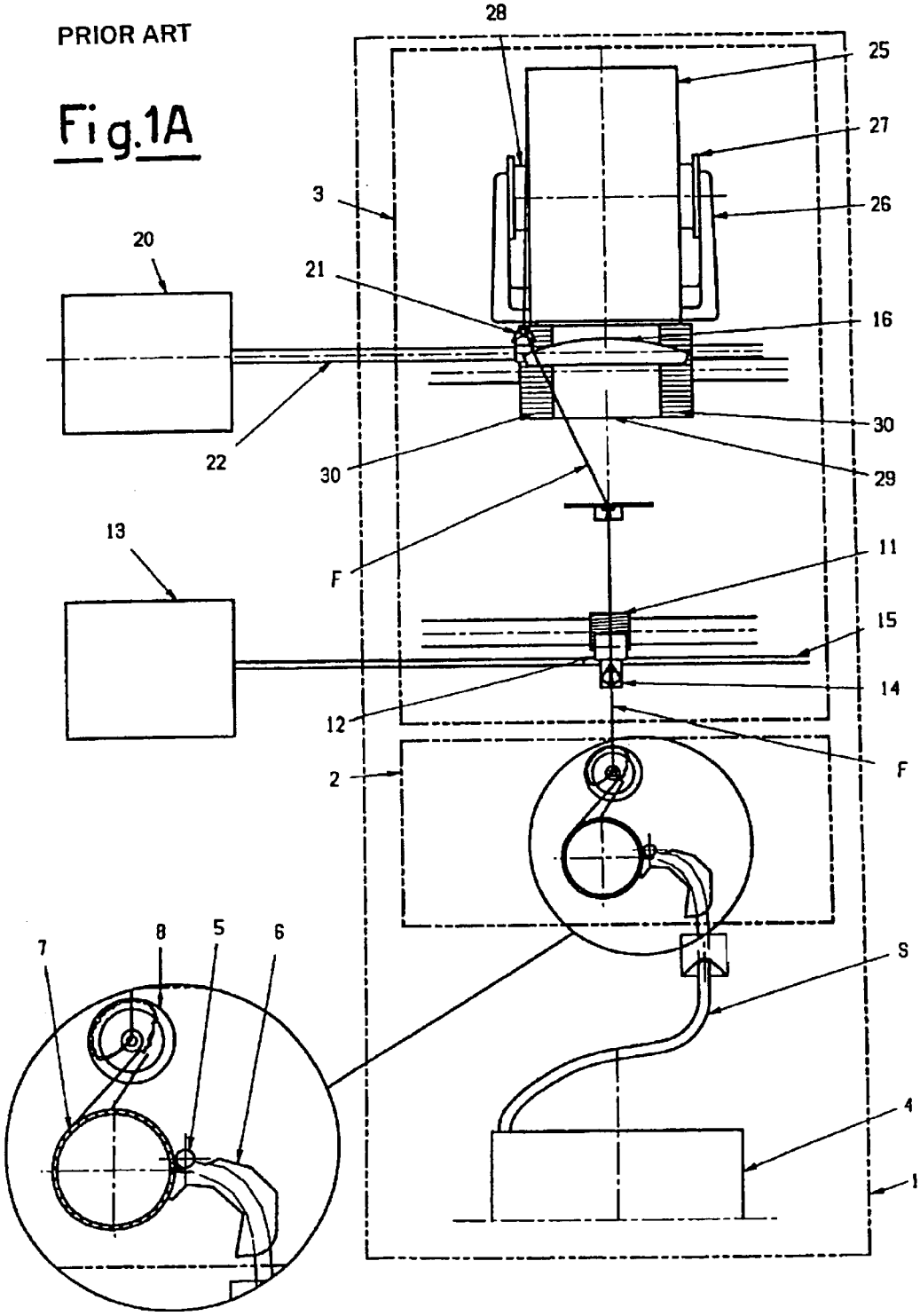
PRIOR ART Fig.1A
FIGS. 1A and 1B show the layout of an open-end spinning station 1 with its most significant components.

Proceeding from the bottom upward, we first encounter the spinning unit 2 and then the pick-up unit 3, the main components of which used to transform staple parallel fibres into the bobbin of wound spun yarn are illustrated briefly below.

The feed strip or staple S is contained in a cylindrical vessel 4 where it is deposited in a double spiral. The staple S is taken up from this and fed to the unit by a feed roller 5 passing through the condenser/funnel conveyor 6. The strip S then passes to the card 7, which rotates at high speed to separate and select the fibres of the staple S and convey then by suction to the spinning rotor 8. In this path the short fibres and impurities are separated, so that only the long and cleanest fibres reach the rotor. The impurities are unloaded into a suction outlet common to all the spinning units.

In the spinning rotor 8, which rotates at a speed $\omega_R$ which reaches 100,000 rpm and over, the fibres are deposited in its peripheral groove through centrifugal force; they are then collected and taken up from here in the form of yarn F.

The fibres are delivered axially from the rotor 8 through the opening of the extractor funnel 9, receiving torsions from rotation of said rotor during the path stretching between its inner groove and said extractor 9, to create the plied yarn F.

The yarn is taken up with an extraction system comprising the extraction roller 11 opposite which is an idle pressure roller 12, generally in elastomeric material and pressed with controlled force to grip the yarn F. This extraction roller 11 is operated at controlled speed and determines the spinning speed or the linear production of spun yarn in relation to time. The ratio $V_F/V_S$ between the linear speeds, generally expressed in meters per minute, of yarn extraction and of staple feed with the rollers 6 determines the drawing ratio occurring during spinning. The ratio between the rotor rotation speed $\omega_R$ and the yarn extraction speed $V_F$ in meters per minute determines the number of torsions per meter imparted in the spinning rotor.

To prevent uneven wear, the spun yarn extraction system is equipped with a weft-moving control 13, consisting of an auxiliary thread-guide 14 mounted on a longitudinal rod 15 in common with the other spinning units which moves longitudinally on the front of the machine. The motion of the auxiliary thread-guide 14 is a backward and forward movement with the so-called pilgrim step, for reduced travel, generally below 10 mm, and moves the yarn F crosswise to obtain uniform wear on the pressure roller 12, preventing grooves from forming rapidly on its surface.

The yarn F thus produced is fed to the pick-up unit 3, still moving upwards, and encounters a compensator 16, consisting of a straight or barrel-shaped profile onto which the yarn is diverted to compensate or at least decrease the variations in length of the path stretching between the spinning unit 2 and the point in which the yarn F is deposited on the bobbin, due to the axial motion of the thread-guiding device 20 it follows.

The yarn F therefore reaches the thread-guiding device 20, which distributes the yarn on the bobbin being formed moving crosswise with backward and forward motion. This consists essentially of a main thread-guide 21 mounted on a longitudinal rod 22 in common with the other spinning units which moves with alternate motion longitudinally on the front of the machine, with an excursion corresponding to the winding travel on the base tube, generally between 120 and 160 mm.

The excursion frequency required is of 100 to 250 forward and backwards strokes per minute, with position precisions in the order of tenths of mm with regard to the axial coordinate of the inversion points.

In prior art different devices are provided to create, adjust and modulate this alternate motion, in frequency, width and axial shift, in order to obtain bobbins that are stable and good quality. These devices use kinematic systems of the connecting rod/crank, four-bar linkage type and so on. In devices of more recent conception, the rod 22 is moved by a large cylinder cam, not shown in the figure for simplicity, driven to rotate at the controlled speed.

Regulation of the cylinder cam rotation speed allows modification of the frequency of the strokes of the thread-guiding devices 20 and the wind ratio of the spun yarn on the bobbin. A further possibility is also provided of adding a second movement of axial modulation to move the motion inversion point of the thread-guides 21 to decrease phenomena of unevenness at the two ends of the bobbin, distributing them over a greater axial extension.

The thread-guide 21 is extremely near the surface of the bobbin being formed. The bobbin 25 is held by the bobbin-carrying arm 26 provided with two openable idle tailstocks 27 which come into contact with the base tube 28 of the bobbin. The bobbin being formed 25 rests on its driving roller or pick-up roller 29. This pick-up roller is provided with one or more drawing bands 30 in a material with a high friction coefficient, generally rubber. In the case of pick-up on conical bobbins these bands make it possible to establish the drive ratio between bobbin and roller, while in the case of cylindrical bobbins they allow a balanced driving torque to be transmitted to the bobbin 25. The bobbin 25 being formed increases progressively in size and weight. The contact pressure of the bobbin on its pick-up roller 29 has a considerable influence on the density of said bobbin. The contact pressure is therefore controlled with a counterweighing system which acts to keep the contact pressure at a determined value, compensating the effects of its increase.

The use of thread-guiding devices 20 with independent action has noteworthy advantages, such as being able to operate with the exact wind ratio required by the production in progress, to control and avoid ribboning on the bobbin, to obtain stable and well-formed bobbins, but still does not solve all winding problems.

Further problems still encountered in winding spun yarn on a bobbin with distribution by means of independent thread-guiding devices 20 are essentially caused by two phenomena.

The first of these concerns distribution of the spun yarn on the generatrix of the bobbin—whether conical or cylindrical—with a thread-guiding means with alternate excursion between the two ends of the winding. This excursion periodically lengthens and shortens the length of the stretch of yarn running between the spinning unit 2 and the point of pick-up on the bobbin 25. This is minimum when the thread-guide is halfway through its travel, and maximum when the thread-guide is at the ends of its travel. This variation therefore causes a first pulsation in the take-up speed of the yarn, as at all times it is necessary to attain from below the algebraic sum of the length of yarn wound on the bobbin with the periodic variation in length—positive and negative—of the path that joins the spinning unit which feeds the yarn F at constant speed and the pick-up element which takes it up a pulsed speed and hence with pulsed tension.

If the bobbin 25 is conical, the phenomena of pick-up speed pulsation is worsened by the fact that when the yarn is wound on the part of the bobbin 25 with the largest diameter there is a second and additional speed pulsation, it is taken up at a higher speed than the speed at which the yarn F is fed from the spinning unit 2 and is therefore subjected to greater tension; instead, when the yarn is wound on the part of the bobbin with the smallest diameter the situation is reversed, the yarn F is slack as it is taken up at a lower speed than the speed at which the yarn is fed from the spinning unit.

The average pick-up speed coincided substantially with the speed at which the yarn is fed by the rotor 8, or just above this to obtain moderate additional draw and ensure the yarn F is always stretched.

The effect deriving from these take up speed and tension pulsations on the yarn F being wound is essentially that of increasing the density and compactness of the bobbin 25 in the points with the greatest tension, or its two ends.

The compensator 16 is only able to provide a partial remedy to this variation in the tension of the yarn F and the consequent more or less dense and compact zones, which is also delayed considerably due to the friction of the yarn which runs axially on its diverter profile.

The second problem encountered in pick-up of the spun yarn F with distribution through the independently operated thread-guiding device 20 derives from the fact that, as the thread-guiding device 21 and its rod 22 have a considerable mass, there are objective limits to the admissible braking and acceleration values, as well as the minimum braking and acceleration times and spaces, which cannot be reduced for evident mechanical reasons.

On the other hand, these times and spaces must in any case come within the order of milliseconds and millimeters respectively, to provide the bobbin with the shape required and sufficient mechanical stability.

As a result of these limits, in the two short end stretches of the stroke where motion is inverted, control of motion inversion due to the profile of the cylinder cam has a radiused trend to avoid impacts, vibrations and damage to the equipment. Consequently, the speed of the thread-guide 21 also has a radiused trend—generally sinusoidal—compared with the axial coordinate, while in the remaining part of its stroke the thread-guide is controlled at a constant speed. In the end stretches it therefore has a lower average speed and a longer stay time, compared with the intermediate zones of its path.

The first consequence of this longer stay time is that a greater quantity of yarn F is deposited at the two flat bases of the bobbin, where the yarn being wound is tighter, making these ends more compact, further increasing the unevenness forming protrusions where the bobbin is already denser. Two terminal bulges give the bobbin an M-shaped profile, which is not a question of appearance; this uneven deposit causes noteworthy drawbacks in the use and further working of the spun yarn wound on said uneven bobbin.

This uneven winding cannot be accepted for some uses of the spun yarn and therefore the bobbin produced in the open-end spinning frame must in these cases be unwound and rewound in a more even bobbin or made up in another form.

The object of the present invention is to produce a device to distribute the spun yarn on bobbins being wound which overcomes the drawbacks of thread-guiding devices available at the state of the art and makes it possible to obtain bobbins with more regular density, shape and stability.

The device according to the invention is defined, in its essential components, in the first claim while its variants and preferred embodiments are specified and defined in the dependent claims.

To illustrate the characteristics and advantages of the present invention in greater detail, it shall now be described with reference to some typical embodiments indicated in FIGS. 1 to 4, purely as a non-limiting example.

Said figures relate to an embodiment of the thread-guiding device according to the invention to distribute yarn on the bobbin being wound, showing only the system to move the longitudinal bar 22 which carries the thread-guides 21 supplying the spinning units aligned along a front of the spinning frame, to illustrate the characteristics and benefits deriving from the present invention.

Figure 1B:
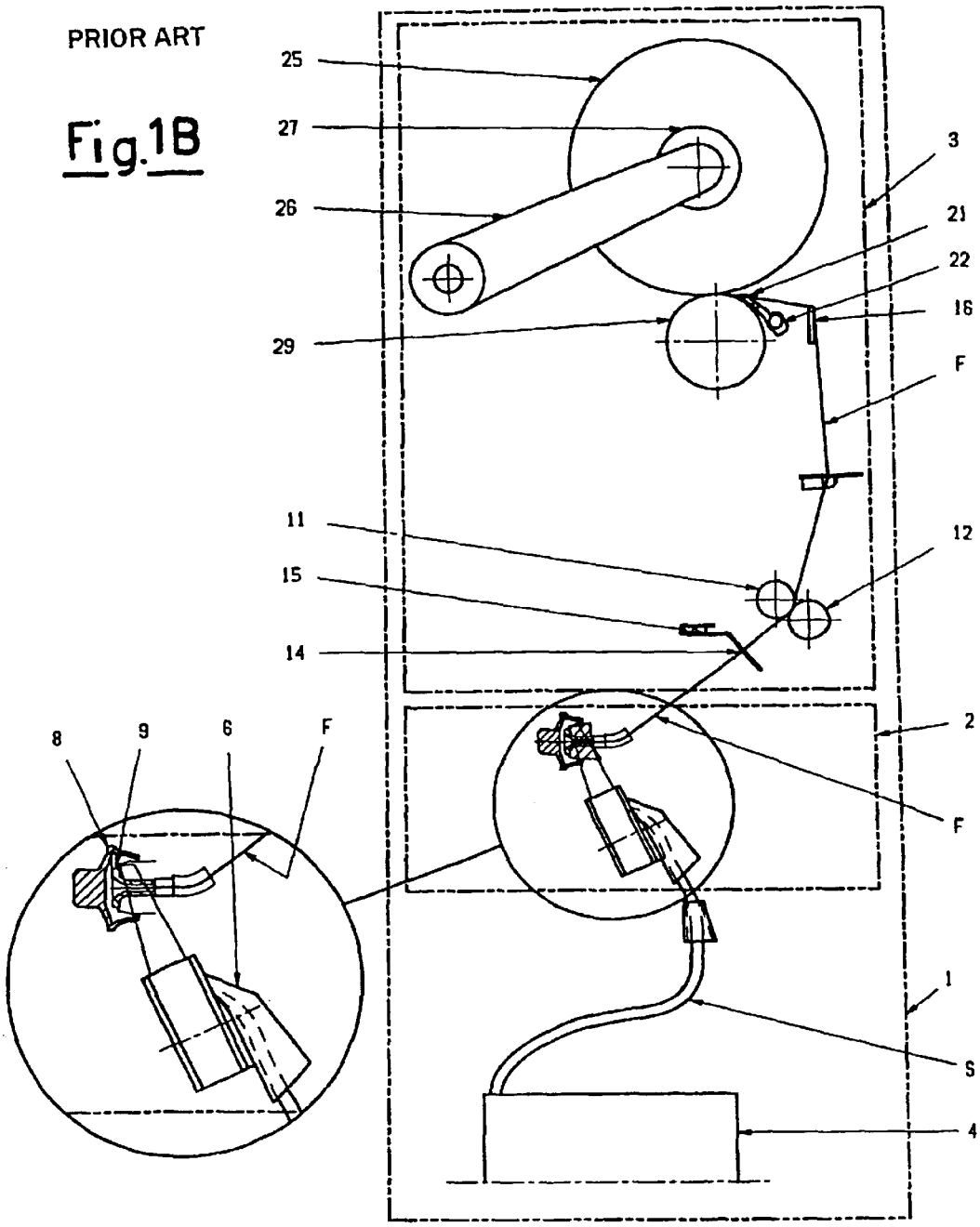
PRIOR ART Fig.1B

FIGS. 1A and 1B schematically show, in a front and side view respectively, a typical embodiment of an open-end spinning unit.

Figures 2A, 2B:
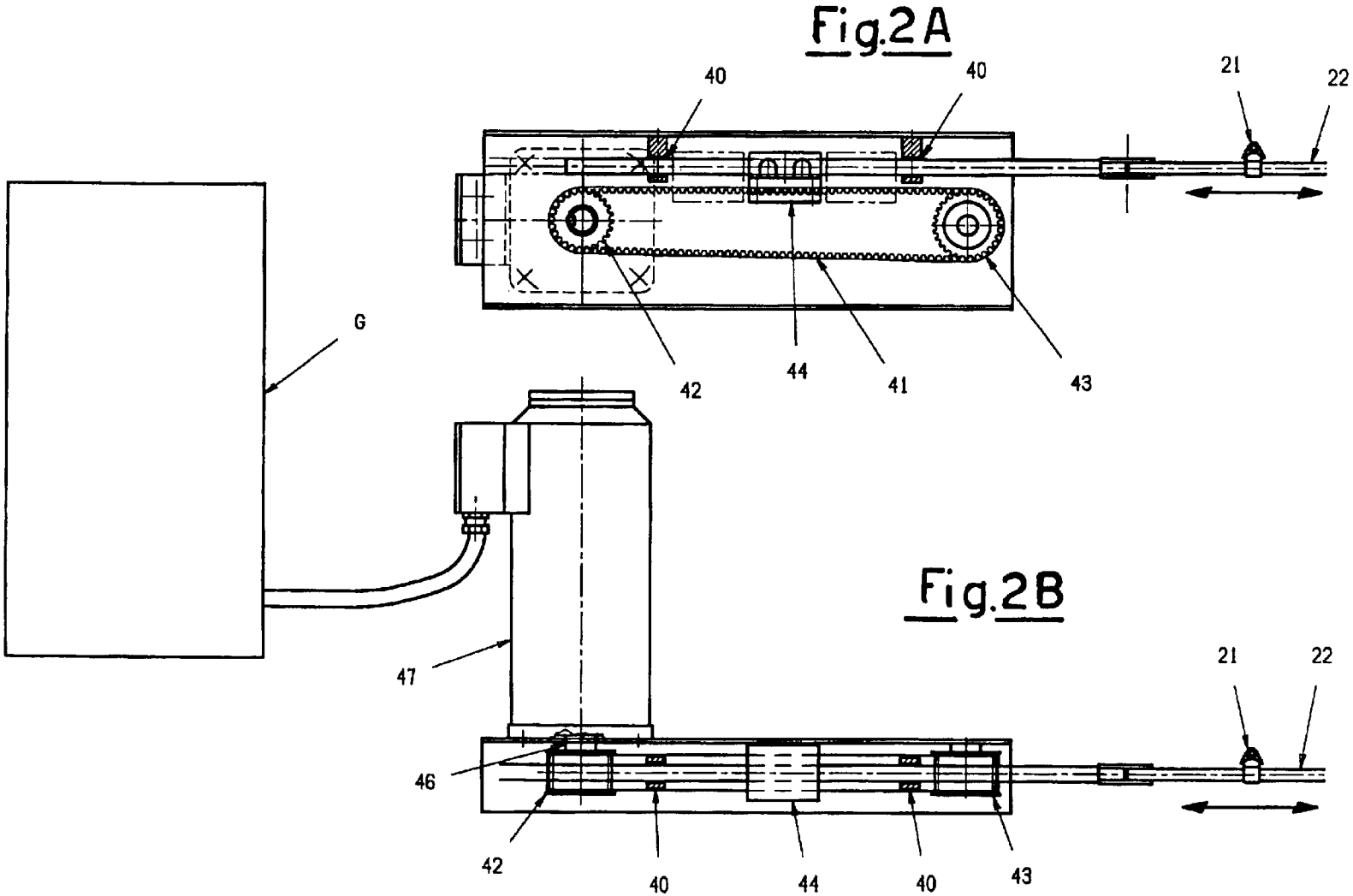
FIGS. 2A and 2B show an embodiment of the thread-guiding device driven by a toothed belt.

The FIG. 2 show an embodiment of the thread-guiding device driven by a toothed belt. FIG. 2A shows its front view while FIG. 2B shows its sectional side view.

Figures 3A, 3B:
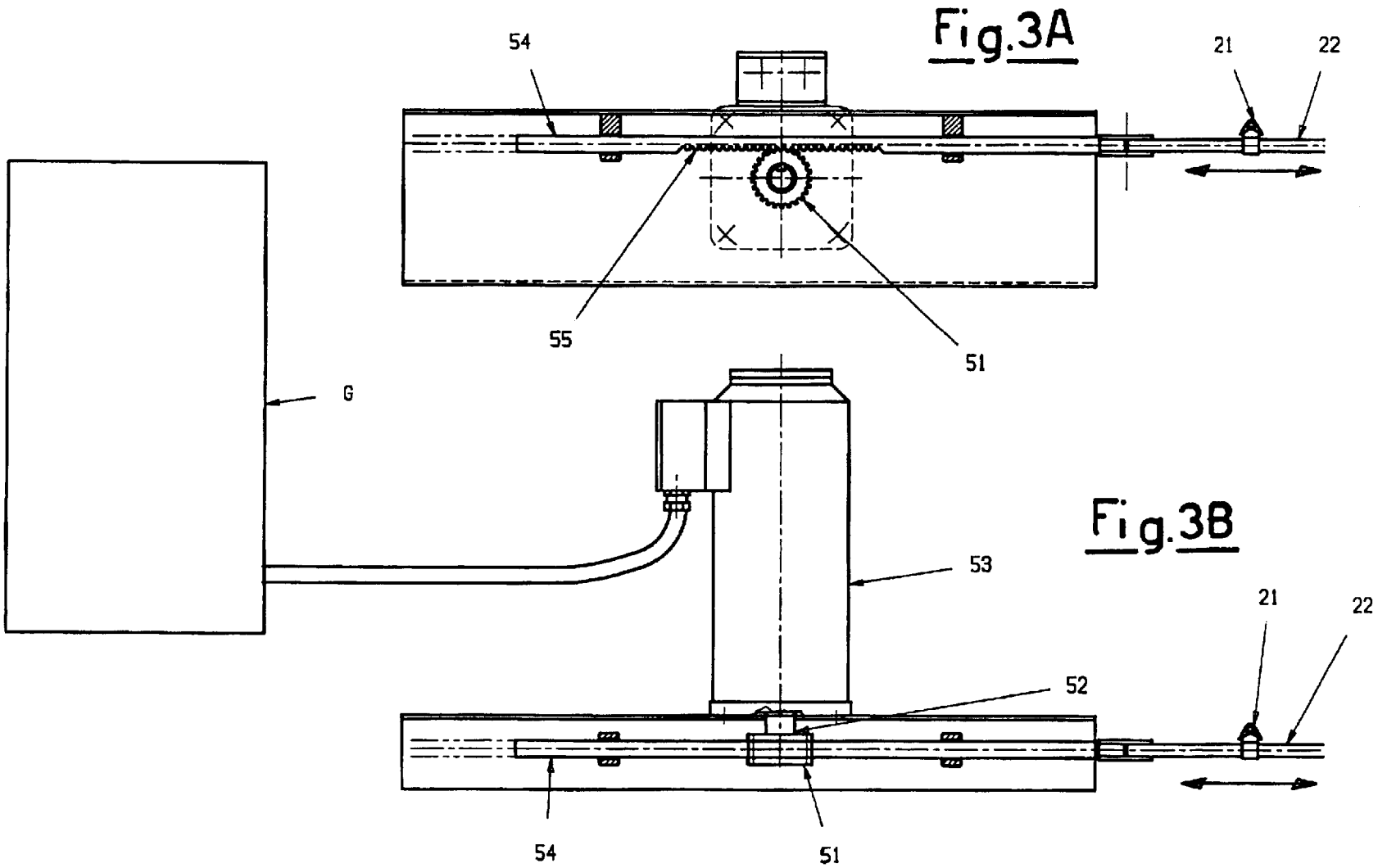
FIGS. 3A and 3B show an embodiment of the thread-guiding device controlled by a rigid rod.

FIG. 3 show an embodiment of the thread-guiding device controlled by a rigid rod. FIG. 3A shows the front view, while FIG. 3B shows the sectional side view.

Figure 4:
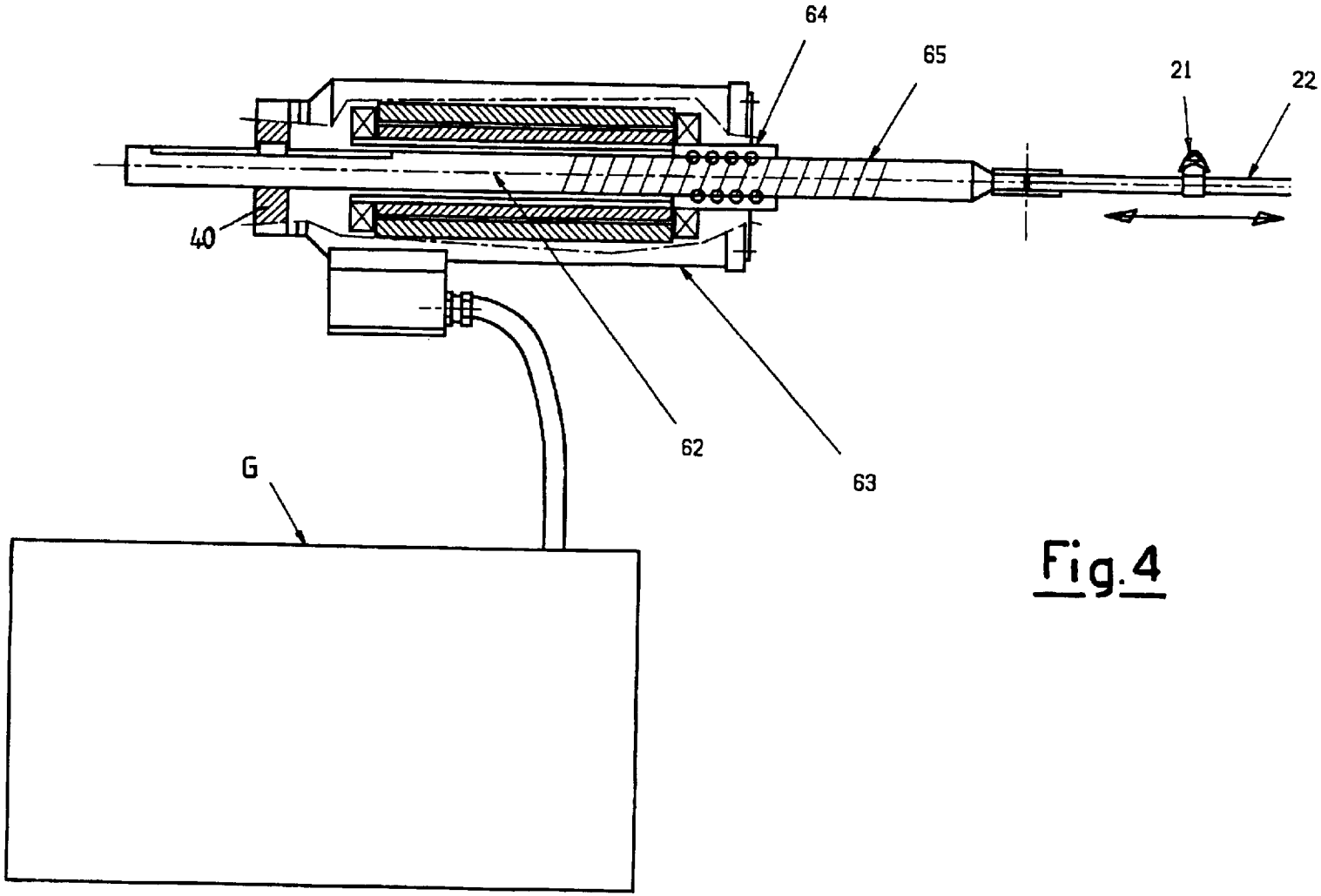
FIG. 4 shows an embodiment of the thread-guiding device with screw/nut screw control in a partly sectional view.

FIG. 4 shows an embodiment of the thread-guiding device with screw/nut screw control in a partly sectional view.

FIG. 2 show the thread-guiding rod 22, which carries the thread-guides 21 preferably formed with wear-resistant and low friction materials such as ceramics, fixed and spaced on said rod according to a span corresponding to the span of the spinning unit 2 in FIGS. 1A and 1B. The moving equipment assembly of the thread-guiding device is produced with maximum saving in weight, employing a design and materials that provide high rigidity and precision of movement with the lowest possible weight, for example employing composite materials for the rods and terminals. The precision of movement and slenderness of the structure therefore require a series of guides 40 aligned along the front of the machine, positioned for example every two spinning units. These guides 40 are provided with low friction and wear-resistant surfaces or coatings in contact with the bar or rod 22.

The bar 22 is made to move alternately to translate its thread-guides 21 in front of the bobbins being formed by the alternate motion of a toothed belt 41 closed and in contact around two toothed wheels 42 and 43 with orthogonal axis compared to the direction of the axial motion of the thread-guide rod. Connection between the toothed belt 41 and the rod 22 is obtained with a fixing clamp 44, in which the belt and rod are preferably made integral with constraints in form such as toothing and slots.

The distance between centres of the two toothed wheels 42 and 43 is in any case dimensioned with an adequate distance to allow excursion of the fixing clamp 44 to take place parallel to the rod 22 without obstacles and difficulties, also for the travel corresponding to the maximum bobbin height to be picked up.

Alternate linear motion drive of the thread-guiding rod 22 is due to the alternate rotation of the toothed wheel 42, the axis 46 of which is in common with the electric motor 47 which is controlled in alternate rotation by the control unit G of the spinning frame. According to a preferred embodiment of the invention the motor 47 is a brushless electric motor, controlled by the control unit G in its alternate clockwise/counterclockwise movement with regard to instantaneous speed, amplitude of angular excursion, angular coordinates of the ends of its travel, and so on.

FIGS. 3A and 3B show the same assembly of thread-guiding rod 22 with thread-guides 21 and guides 40 already described with reference to FIG. 2.

According to the embodiment shown in FIG. 3, the bar 22 is driven in alternate movement to translate its thread-guides 21 in front of the bobbins being formed by the alternate motion directly by the alternate rotary motion of the toothed wheel 51, the axis 52 of which is in common with the axis of the electric motor 53, entirely analogous to the previous one, which is controlled in alternate rotation by the control unit of the spinning unit. The connection between bar 22 and teeth of the toothed wheel 51 is obtained here by producing the terminal part of the rod 22 with a more rigid part 54 in which toothing 55 corresponding to the toothing of the toothed wheel 51 is produced, to convert and transmit rotatory alternate motion of the motor 53 into translational alternate motion of the rod 22.

FIG. 4 shows the same thread-guiding rod 22 assembly with thread-guides 21 and guides 40 already described with a variant in the type of drive.

The connection between bar 22 and axis 62 of the electric motor 63—entirely analogous with the motors controlled in alternate motion of the embodiments shown in the previous figures—is produced with a screw/nut screw system.

A worm screw 64 is keyed onto the axis 62 of the motor 63, while the terminal part of the rod 22 is produced with a nut screw 65 correspondingly grooved to mesh and transmit the motion of the screw 64. The screw/nut screw 64, 65 system converts and transmits rotatory alternate motion 63 into translational alternate motion of the rod 22, analogously to the previous embodiments.

According to a possible alternative embodiment of the present invention, and especially in the case in which it is applied to a rotor spinning frame constituted by a high number of spinning units, the length of the thread-guiding rod 22 becomes considerable. The precision of the motion inversion points of the thread-guide 21 is therefore influenced by the fact that the sudden accelerations and decelerations, which move a long rod such as the rod 22, cause periodic lengthening and shortening vibration of the rod through the effect of the inertia forces, which creates greater excursion at the ends of the thread-guiding rods.

To reduce this phenomenon, according to an alternative embodiment of the invention the rod 21 is divided into two half-rods installed on the two parts of their driving means 41, 55 or 65, which in turn is positioned in a central zone of the front of the open-end spinning frame. In the backward and forward motion of said comprehensive rod, the length available for said periodic lengthenings and shortenings is halved and, while one of the two half-rods is compressed, the other is stretched through the effect of the inertia forces.

The thread-guiding device according to the present invention has substantial improvements compared to prior art devices. Of these, at least the following deserve a mention. The drive control with brushless motor controlled by the control unit allows modulation of the wind ratio in relation to the pick-up speed so as to prevent phenomena of ribboning, and even allowing precision winding to be obtained. In view of the fact that normally bobbins at different stages of winding and with very different dimensions are found on open-end spinning frames, control of the brushless motor with continual modulation, overlapping various types of profile, triangular, sinusoidal, random and so on, makes it possible to obviate phenomena of ribboning even without monitoring the degree of feed of each of these bobbins individually.

Controlled drive of the brushless motor allows, even maintaining a constant length of thread-guide travel, modulation of the motion inversion points so as to distribute them axially on a discrete stretch for an excursion of a few millimeters on both sides, and thus decrease the peak of increase in density and compactness which otherwise occur at the ends of the bobbin 25.

The effect of the M-shaped terminal bulges of the side profile of the bobbin may also be eliminated or at least diminished, by running the motor at discrete intervals of time with shorter rotatory excursions, that is with thread-guide travel of a reduced length, in order to fill the depression between the end bulges, caused by more yarn being deposited at the ends of the bobbin 25 due to the lower instantaneous speed of the thread-guide.

Alternatively, this unevenness can be obviated by modifying the wind ratio in correspondence with the middle stretch of the travel, or by decreasing the excursion speed of the thread-guide in the central stretch of its excursion, controlling the frequency of the brushless motor to decrease its angular speed in the central stretch of its alternate rotation.

The electronic control system of the thread-guide according to the invention is capable of optimally performing all the functions required of the mechanical system generally employed on open-end spinning frames of the most recent conception, but with noteworthy advantages compared to this, the most important points of which are set forth below.

Simply by modulating the control frequency of the brushless motor the following are obtained:

- backward and forward movement of the thread-guiding rod common to the entire machine front, which in the mechanical system is obtained with a rotary cylindrical cam with a groove or rib on which a sliding guide moved by horizontal motion engages. The assembly is very heavy and complicated;
- modulation to avoid ribboning, which in the mechanical system is generally obtained by overlapping a sinusoidal motion over a basic uniform motion, obtained with an epicyclical mechanism, or by disturbing the basic motion with coupling/uncoupling devices which provide a random trend, with motion not strictly controlled;
- axial movement of the thread-guide to prevent or reduce the formation of hard edges and bulges at the ends of the bobbin, which the mechanical system implements with axial forward/backward translations of the thread-guide control.

In addition to these functions of the conventional thread-guide, the electronic control system of the thread-guide according to the invention is capable of producing further performances and of solving recurrent problems in the open-end spinning frame with mechanically controlled thread-guide, especially with staggered formation of bobbins, that is with bobbins at different degrees of feed along the front of the machine.

It is worthwhile mentioning the much greater modulation efficiency with profiles of speed variation that can be varied as desired (sinusoidal, triangular, random, by points and so on) which as a function of the spun yarn being produced are must more efficacious to prevent ribboning.

Axial movement is modulated by varying the travel and frequency, for example by reducing the travel, to avoid risks of drop at the tip and base of the bobbin.

It is extremely important that the speed profile along the travel of the thread-guide can be varied, so as to obtain a deposit of spun yarn with the desired distribution of density, typically decreasing the translation speed at the centre of the bobbin where the density is usually lower. It is also possible to periodically control much shorter travel than normal to optimize the density of the bobbin and avoid end bulges, with further benefits also in eliminating ribboning.

Finally, the electronic control system of the thread-guide according to the invention allows precision bobbins to be produced in layers—which mechanical systems to control the thread-guide according to prior art would not be capable of—also working on staggered bobbins, that is without the need for all the bobbins on the front of the machine to be of the same diameter and length, or with the same degree of feed.

This procedure consists in winding layers of the same length on the bobbin, produced with a constant pitch and with a wind ratio that decreases as the diameter increases. At the end of each layer the initial wind ratio is returned to and another layer is deposited and so on. In this way very dense and uniform bobbins are obtained, similar to those of the precision bobbins, even when working with bobbins with staggered feed.

The only difference between the bobbins is due to the fact that, at the start of a new bobbin, the first layer is in a random condition between the start and end, but by operating with a large number of layers to constitute the bobbin, this circumstance has no influence whatsoever on the quality or appearance of the finished bobbin.

What is claimed is:

1. Thread-guiding device for collecting spun yarns on bobbins, particularly for open-end spinning frames, constituted by a thread-guiding rod which carries the thread-guides, fixed and spaced apart with a span corresponding to the span of the spinning units, positioned on a series of guides and driven in alternate movement to translate its thread-guides in front of the bobbins being formed by the alternate motion of a driving means wherein said driving means is controlled in turn by a motor, capable of alternate rotation, and is controlled by a control unit of the spinning frame and wherein said driving means is formed of the terminal part of said rod in which toothing corresponding to the toothing of the toothed wheel is produced, the axis of which is in common with the axis of the electric motor which is controlled in alternate rotation by the control unit of the spinning frame.

2. Thread-guiding device for collecting spun yarns on bobbins, particularly for open-end spinning frames, constituted by a thread-guiding rod which carries the thread-guides, fixed and spaced apart with a span corresponding to the span of the spinning units, positioned on a series of guides and driven in alternate movement to translate its thread-guides in front of the bobbins being formed by the alternate motion of a driving means wherein said driving means is controlled in turn by a motor, capable of alternate rotation, and is controlled by a control unit of the spinning frame and wherein the driving means is formed of a screw/nut screw system in which a worm screw is keyed onto the axis of the motor and the terminal part of the rod is produced with a nut screw correspondingly grooved to mesh and transmit the motion of the screw, the motor being controlled in alternate rotation by the control unit of the spinning frame.

3. Thread-guiding device as claimed in claim 1 wherein the driving means is positioned in a central zone of the front of the opening-end spinning frame.

4. Thread-guiding device as claimed in claim 2 wherein the driving means is positioned in a central zone of the front of the opening-end spinning frame.

* * * * *